United States Patent [19]

Dillman

[11] Patent Number: 4,624,576

[45] Date of Patent: Nov. 25, 1986

[54] ADJUSTMENT OF DRUM MIXER TRUNNIONS

[75] Inventor: Bruce A. Dillman, Cape Coral, Fla.

[73] Assignee: Bituma Construction Equipment Company, Marquette, Iowa

[21] Appl. No.: 749,316

[22] Filed: Jun. 26, 1985

[51] Int. Cl.[4] ..... B28C 5/18

[52] U.S. Cl. ..... 366/63; 34/108; 432/103; 366/62; 366/220; 366/233

[58] Field of Search ..... 366/25, 44, 53, 54, 366/60, 62, 63, 92, 93, 220, 233; 34/108; 69/30; 74/206, 209, 215, 674; 432/103

[56] References Cited

U.S. PATENT DOCUMENTS

| | | | |
|---|---|---|---|
| 1,916,047 | 6/1933 | Groseclose | 366/233 X |
| 2,497,736 | 2/1950 | Muller | 366/63 X |
| 2,722,408 | 11/1955 | Hilkemeier | 366/63 |
| 3,033,057 | 5/1962 | Gray | 74/206 |
| 3,589,303 | 6/1971 | Lakin | 74/206 X |
| 3,711,075 | 1/1973 | Raevsky et al. | 432/103 X |
| 3,910,563 | 10/1975 | Vissers et al. | 366/63 X |
| 4,069,975 | 1/1978 | Laubach et al. | 366/62 X |
| 4,071,961 | 2/1978 | Dietzel et al. | 34/108 |
| 4,171,949 | 10/1979 | Endersen et al. | 432/103 |
| 4,273,000 | 6/1981 | Schmid | 366/63 X |

*Primary Examiner*—Timothy F. Simone
*Attorney, Agent, or Firm*—James E. Nilles; James R. Custin

[57] ABSTRACT

In a mixer having an elongated rotatable drum surrounded by coaxial front and rear tires, the invention facilitates adjustment of the positions of the two trunnion units that supportingly and drivingly engage each tire. Each trunnion unit comprises a base member horizontally shiftably slidable on the mixer frame and a tire engaging roller confined to rotation relative to the base member. Opening to front and rear ends of each trunnion unit are holes that are coaxial with its roller axis. Fixed to one side of the mixer frame are two locating fixtures, each having holes opening to front and rear end surfaces thereon, all of those holes having coinciding axes. Three U-shaped gages are provided, each having tangs which are closely receivable in said holes and which project laterally from opposite ends of an elongated lengthwise adjustable body portion. Two of the gages are used with the locating fixtures to position their adjacent trunnion units. The third gage, substantially longer, is used to position the other two trunnion units.

8 Claims, 10 Drawing Figures

ADJUSTMENT OF DRUM MIXER TRUNNIONS

FIELD OF THE INVENTION

This invention relates to improvements in drum mixers of the type wherein an axially elongated mixing drum around which there are two axially spaced trunnion engaging rings or tires is both supported and driven for rotation by means of two pairs of trunnion rollers, one pair engaging each of said rings; and the invention is more particularly concerned with means for readily adjusting the positions and orientations of the several trunnion rollers so that they share equally in supporting and driving the drum and in resisting its axial displacement.

BACKGROUND OF THE INVENTION

In a drum mixer of the type to which this invention relates, the mixing drum is rotatably mounted on an elongated rigid frame which often comprises a trailer chassis that provides for transporting the mixer from one job site to another. The drum itself is substantially cylindrical and axially elongated, its length being typically on the order of 40 ft. (12 meters). The rear end of the drum, which is its inlet or charging end, is usually at a higher elevation than its front or discharging end so that the drum axis is inclined at an angle of about $2\frac{1}{2}°$ to $3\frac{1}{2}°$ to the horizontal.

In the type of drum mixer here under consideration, the drum is surrounded by two coaxial trunnion engaging rings or so-called tires, one near its charging end and the other near its discharging end. Each of these tires has a plainly cylindrical peripheral surface concentric to the drum axis, and has flat front and rear surfaces lying in planes normal to the drum axis. The drum is both supported and driven for rotation by means of two pairs of trunnion rollers, one pair for each tire, the two trunnion rollers of each pair being spaced to opposite sides of the drum axis. Each trunnion roller has a plainly cylindrical peripheral surface that rollingly engages the cylindrical periphery of its tire.

For reasons explained below, the trunnion rollers must be individually adjustable in horizontal directions transverse to their axes. To that end each trunnion roller is rotatably mounted on its own base structure, and each base structure is slidably adjustable on the frame. Each base structure carries a gear box through which its trunnion roller is driven from an electric motor or the like. Ordinarily there are two electric motors for drum rotation, one for each pair of trunnion rollers, each motor being mounted on the frame between its trunnion rollers. On the exterior of each gear box there is a driving sheave that has a belt connection with the adjacent motor.

It will be apparent that the drum must be maintained at an axial location at which each of its tires is fully engaged with the pair of trunnion rollers for that tire. That location is defined by means of front and rear thrust rollers which are freely rotatable on vertical axes and which are mounted on the mixer frame directly below the drum axis for cooperation with the front tire. The front thrust roller rollingly engages the flat front surface of the front tire; the rear one similarly engages the flat rear surface of that tire.

If the axes of the four trunnion rollers extended fore-and-aft exactly parallel to the vertical plane containing the drum axis, the drum would have a tendency to be moved axially forward by gravity as it rotated, owing to the rearward and upward inclination of its axis. Although the front thrust roller would prevent the drum from moving so far forward that the tires would be disengaged from the trunnion rollers, the high thrust force that the drum and its contents would impose upon that thrust roller would soon cause excessive wear of both it and the front tire.

To avoid this, the four trunnion rollers are adjusted so that the axis of each, although extending horizontally, is skewed slightly out of parallelism with the vertical plane that contains the drum axis. By reason of this skewed orientation of the trunnion roller axes, each trunnion roller, as it rotates, imparts a small component of axial driving force to the drum in the "uphill" direction, in addition to the substantially large component of rotational driving force that it imparts to the drum. Since all of the trunnion rollers rotate in the same direction, all of their axes should have the same direction and amount of skew, which is to say that all four trunnion roller axes should be parallel to one another and slightly oblique to the vertical plane containing the drum axis. If the axes of the trunnion rollers are excessively skewed, the rear thrust roller will be overloaded. Thus the amount of such skew should be just enough for the forward force of gravity upon the drum to be counterbalanced by the rearward force due to the trunnion rollers, so that the drum imposes no substantial load upon either of the thrust rollers.

Heretofore there has been no satisfactory method or means of ensuring accurate adjustment of the orientations of the trunnion roller axes, and in particular there has been no reliably accurate means for checking parallelism of the trunnion roller axes. The lack of such an expedient has had expensive consequences. If the axes of the four trunnion rollers are not parallel, then the trunnion rollers impose unequal axial forces upon the drum and in effect work against one another. This condition results in scuffing of the peripheral surfaces of the trunnion rollers and the tires, and it can occasion the need for replacement of those parts after a relatively short period of operation. Replacement of a trunnion roller is no small matter in terms of cost of the roller, labor involved in making the replacement, and down time on the mixer; but replacement of a drum tire is much more expensive because it requires that the drum be cut apart.

Heretofore the usual expedient for trunnion adjustment has been to use a tape measure to measure from an edge of the mixer frame to marks designating the centers of the trunnion roller shafts. Because of difficulties and inaccuracies attending the use of a tape measure, correct adjustment of all four trunnion rollers was difficult to achieve and was likely to be as much a matter of luck as of skill. The result was that the trunnion rollers and tires on a drum mixer had a useful life that was often as short as two years and was rarely equal to the useful life of the rest of the machine.

Adjustment of the trunnion rollers is not a one-time requirement but must take place rather frequently during the life of a drum mixer. The angle of tilt of the drum axis to the horizontal is adjusted by raising or lowering one end of the mixer frame and should be established in accordance with the type of material being mixed and the rate at which it must pass through the drum. Any change in this tilt will of course require a change in the angle of skew of the trunnion roller axes.

Proper adjustment of the trunnion rollers is complicated by the fact that the effect of their axial skew varies with the weight of the load in the mixer. Somewhat paradoxically, if the orientation of the trunnion roller axes is such that the front tire bears lightly against the front thrust roller when the drum is empty, that tire will bear against the rear thrust roller when the drum is operating under full load. Apparently the weight of the load urges the drum into more firm engagement with the trunnion rollers, so that there is less slippage between them and the respective tires, with the result that the "uphill" component of driving force that the rollers exert upon the drum increases to a greater extent than the "downhill" force that gravity exerts upon the loaded drum and its contents.

Since a normal load weighs substantially more than the drum itself, the usual procedure is to so adjust the trunnion rollers, with the drum running under full normal load, as to bring the front tire into light engagement with the rear thrust roller. With such an adjustment properly made, the front tire will lightly engage the front thrust roller when the drum is empty.

It is not easy for an unskilled person to understand and visualize the forces that the drum and the trunnion rollers exert upon one another and to appreciate the kind and amount of adjustment that must be given to each individual trunnion roller during an adjustment procedure. Furthermore, the persons performing an adjustment procedure have heretofore been guided through it only by their own knowledge and skill rather than by mechanical constraints imposed by the involved apparatus. Because of these factors, mistakes were frequent, even when adjustments were made by skilled and conscientious personnel.

SUMMARY OF THE INVENTION

The general object of the present invention is to provide simple, sturdy and very accurate means for simplifying, expediting and increasing the accuracy of the procedure for adjusting the trunnion rollers of a drum mixer of the character described, whereby the trunnion rollers can be readily brought to positions in which they all engage the drum to cooperate in supporting and driving it and to orientations in which their axes are accurately parallel and they are effective to prevent the drum from excessively loading either of the thrust rollers.

Another general object of the invention is to provide apparatus that enables one person, working alone, to achieve quick and accurate adjustment of the trunnion rollers of a drum mixer of the character described and which tends to constrain the person making the adjustments to follow a procedure that ensures correct and accurate adjustments.

Another general object of the invention is to provide apparatus which affords a maximum useful life for the expensive trunnion rollers and drum tires of a drum mixer by enabling adjustments of the positions and orientations of the trunnion rollers to be made quickly, easily, accurately and with a minimum of chances for error.

A more specific object of the invent:on is to provide a set of simple, sturdy and inexpensive gages for use in adjusting the positions and orientations of the trunnion rollers of a drum mixer, which gages can be quickly and easily adjusted and cooperate in a reliable and easily understood manner with elements of the mixer structure to provide for fast and very accurate adjustment of the trunnion rollers.

These and other objects of the invention that will appear as the description proceeds are achieved in the apparatus of this invention, which is intended for cooperation with a drum mixer comprising a rigid frame that is elongated in a fore-and-aft direction, an axially elongated drum that has a drum axis and is encircled by coaxial front and rear trunnion engaging rings, and two pairs of trunnion units, one pair for each said ring, whereby the drum is driven for rotation and is supported above a top surface of the frame and between opposite sides thereof with its said axis extending substantially in said direction, the two trunnion units of each pair being at opposite sides of the drum axis. Each trunnion unit comprises a base member which is slidingly adjustable on said top surface of the frame transversely to said fore-and-aft direction and which has front and rear ends that are spaced apart in said direction, and a roller on the base member which is confined to rotation relative to the base member about a roller axis that extends through said front and rear ends of the base member.

The apparatus of this invention, which comprises means for facilitating accurate adjustment of the positions and orientations of the trunnion units relative to one another, comprises means on each trunnion unit defining a pair of holes that are coaxial with the roller axis of the trunnion unit, one of said holes opening to the front end of the trunnion unit and the other to its rear end. Fixed on the frame, adjacent to one side thereof, are a pair of locating fixtures, one for each pair of trunnion units. Each said locating fixture has front and rear end surfaces that are substantially in vertical planes respectively containing the front and rear ends of the base members of its pair of trunnion units. Each said fixture has a hole opening to each of its said end surfaces, the axes of said holes in both locating fixtures being on a single line extending in said fore-and-aft direction. The apparatus is further characterized by a plurality of substantially U-shaped gages, each having an elongated body portion, a tang projecting laterally from the body portion at each end thereof, each said tang being closely slidably receivable in one of said holes, and means on the body portion for adjustably varying the distance between said tangs.

Preferably the elongated body portion of each gage comprises a pair of elongated body elements, each of which has one of said tangs secured to one end thereof, and means providing a threaded connection between said body elements, at the other end of each, whereby said distance between the tangs is adjustable by rotation of the body elements relative to one another.

Preferably there are two relatively short gages and one substantially longer one, and the threaded connection of each gage has the some pitch as that of the others. The two relatively short gages are employed to establish the two trunnion units that are adjacent to said one side of the frame in orientations such that their roller axes are parallel. The longer gage is employed to position the other two trunnion units at like distances from the first two and with their roller axes parallel to those of the first two.

BRIEF DESCRIPTION OF THE DRAWINGS

In the accompanying drawings, which illustrate what is now regarded as a preferred embodiment of the invention.

DETAILED DESCRIPTION OF PREFERRED EMBODIMENT OF THE INVENTION

Figure 1:
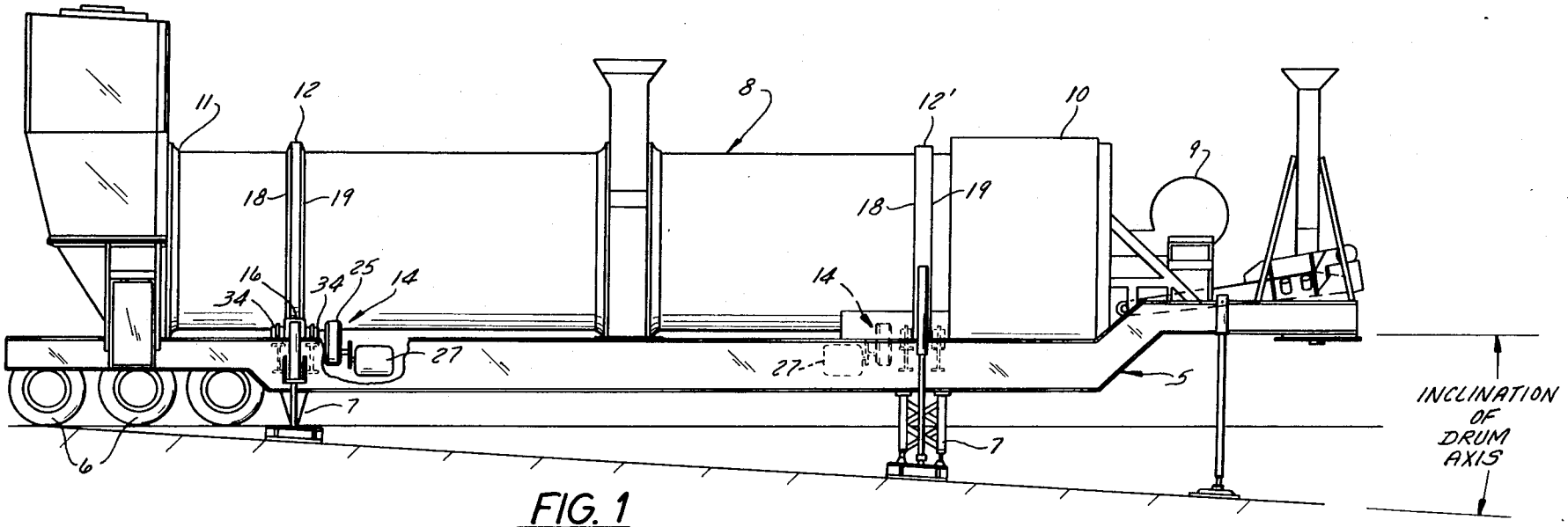
FIG. 1 is a view in side elevation of a drum mixer of the type to which this invention relates.
Figure 2:
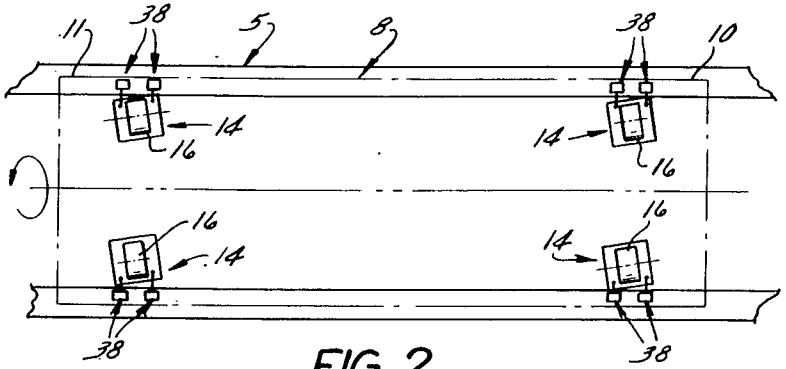
FIG. 2 is a diagrammatic plan view showing the relationship of the roller axes of the trunnion units to the drum axis, with the skew of the roller axes exaggerated for clarity.
Figure 8:
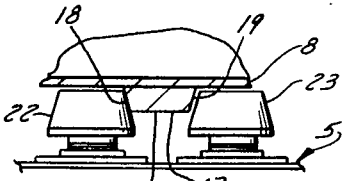
FIG. 8 is a detail sectional view showing the thrust rollers, taken on the plane of the line 8—8 in FIG. 6.
Figure 3:
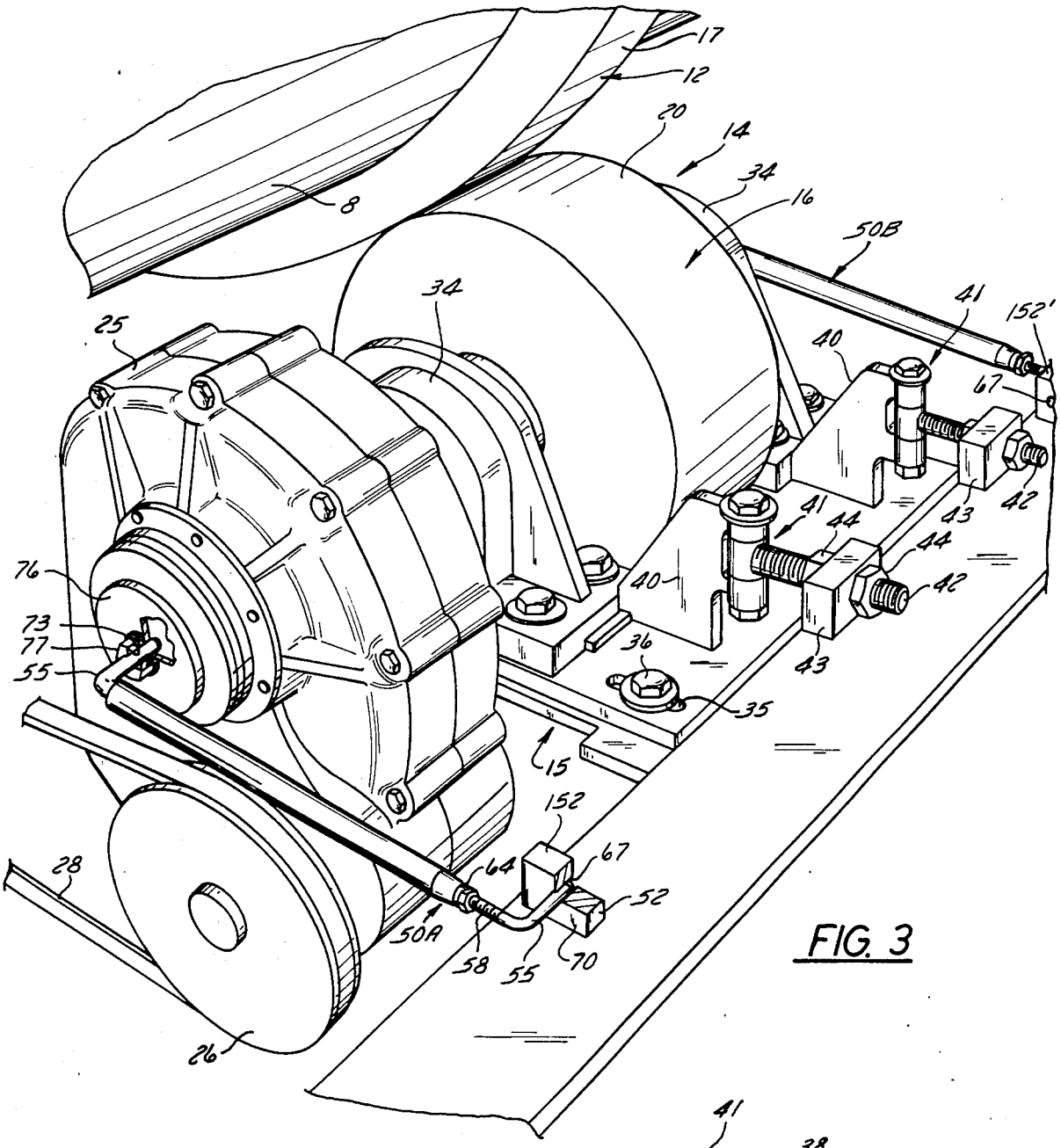
FIG. 3 is a perspective view of one of the trunnion units with two of the gages of this invention temporarily fitted to it.
Figure 4:
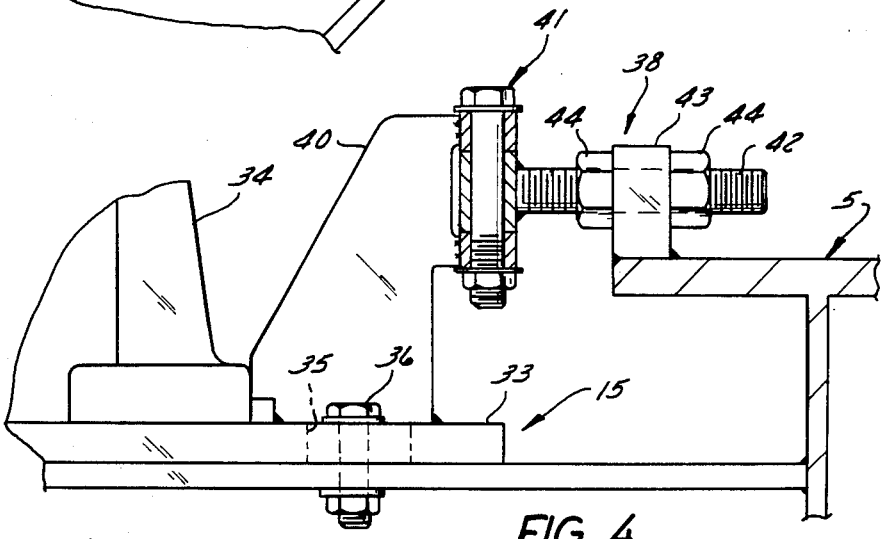
FIG. 4 is a detail view in end elevation of one of the positioning devices.
Figure 5:
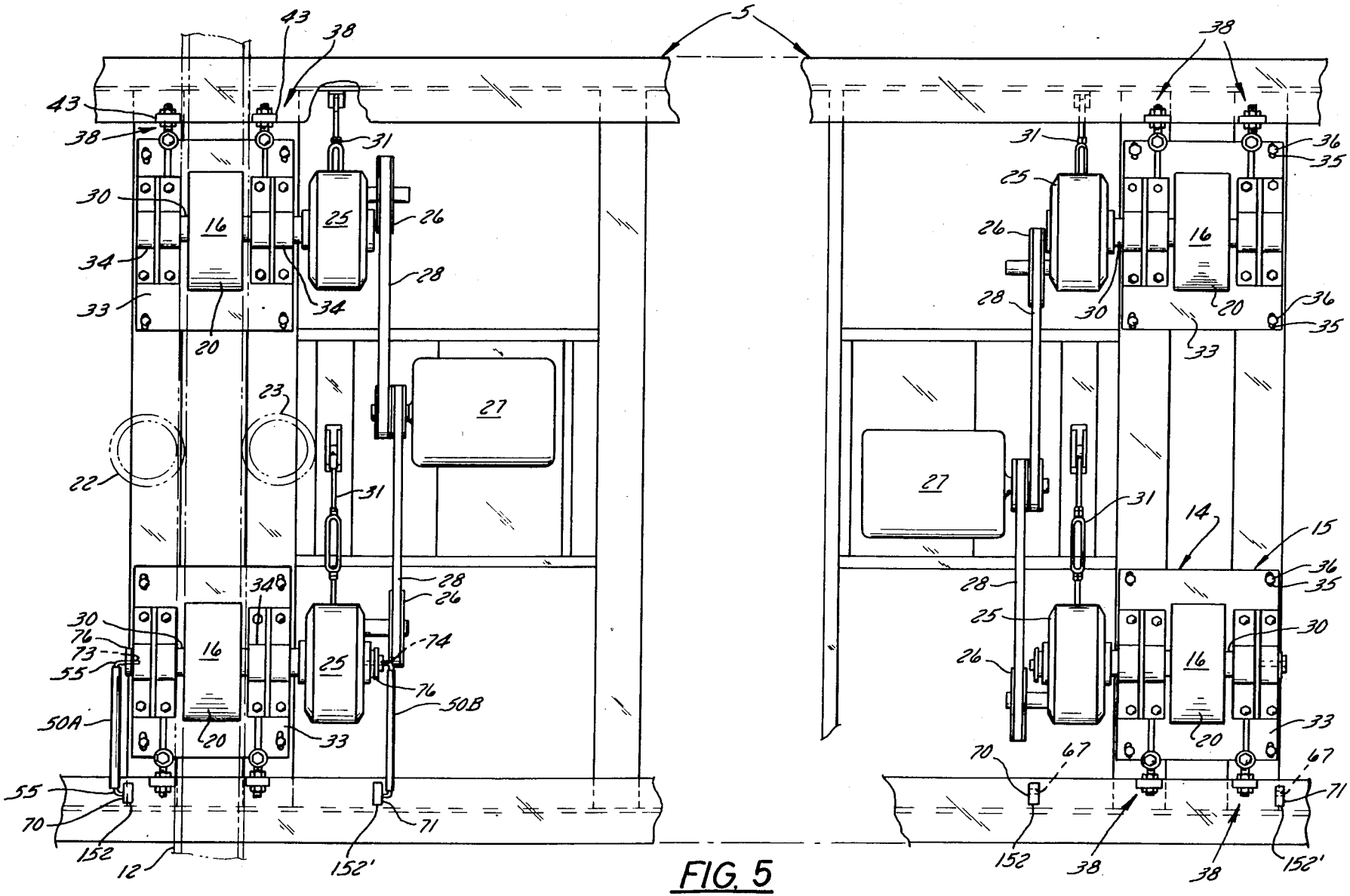
FIG. 5 is a view looking downward on the mixer frame with the drum removed and showing the trunnion units.
Figure 6:
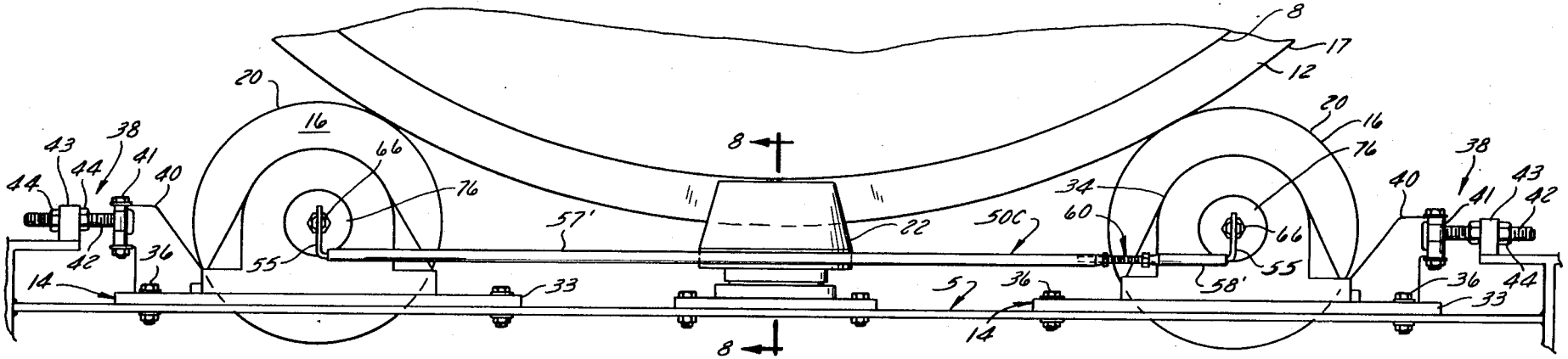
FIG. 6 is a detail view in front elevation taken on a plane just in front of the front thrust roller and showing the long gage in use.
Figure 7:
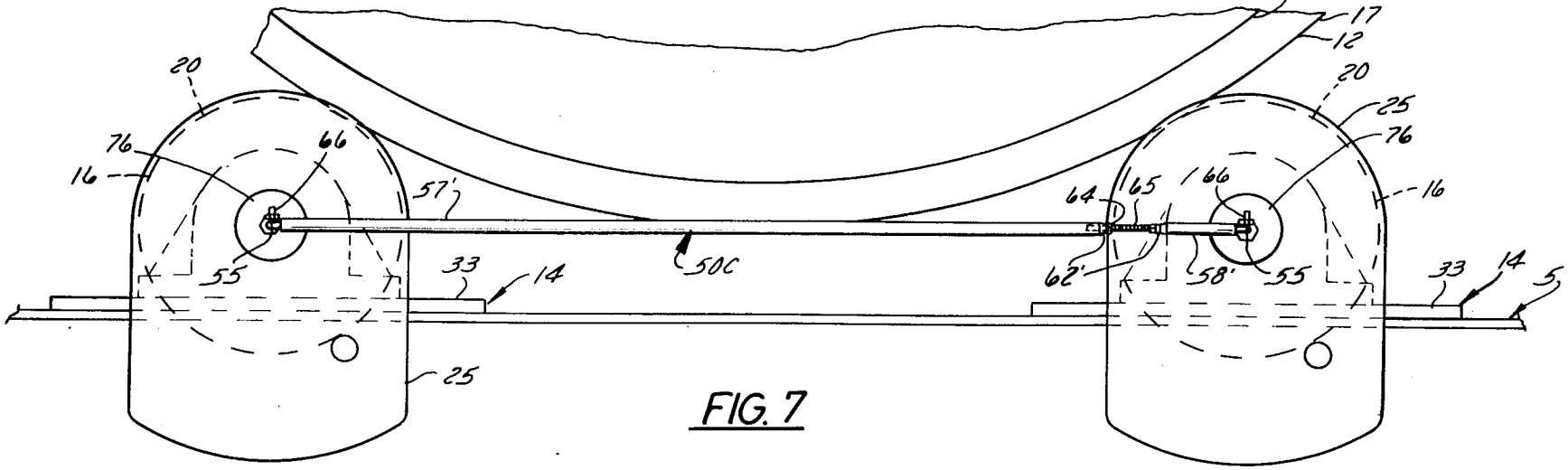
FIG. 7 is a detail view in rear elevation, taken on a plane just in front of the rear trunnion units and again showing the long gage in use.
Figure 9:
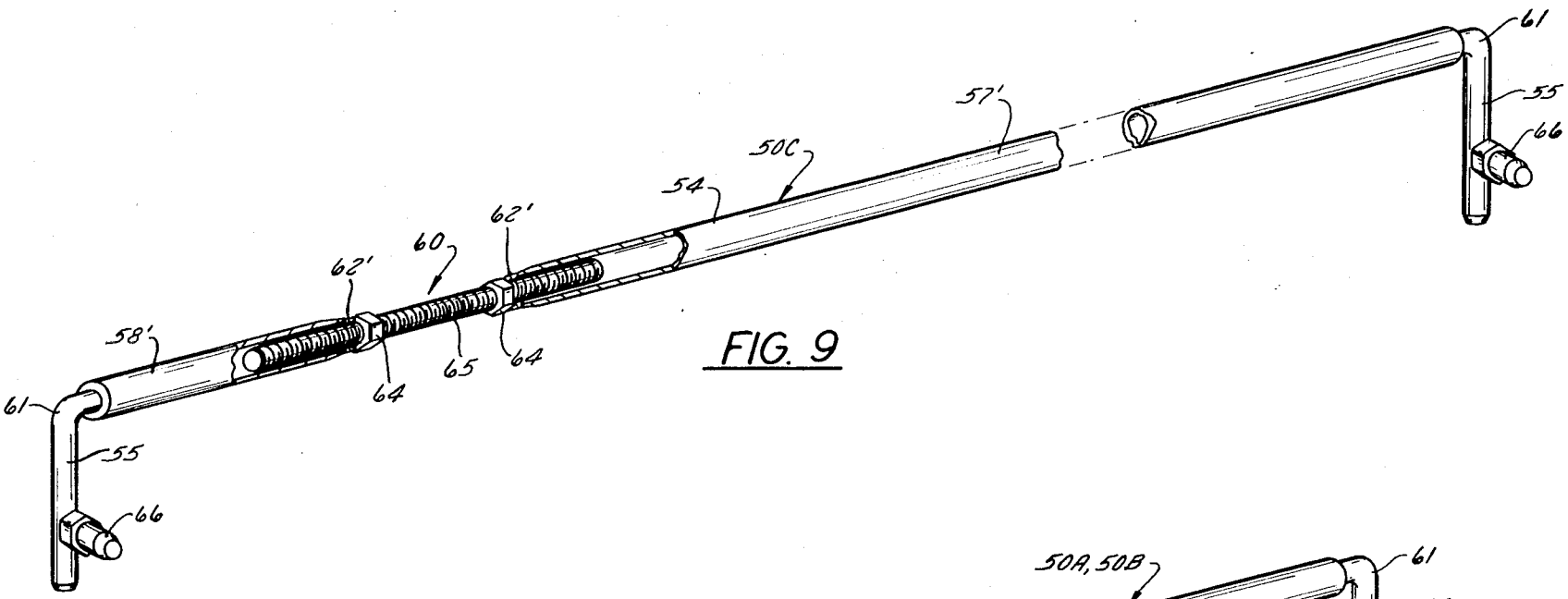
FIG. 9 is a perspective view of the long gage, with portions shown broken away.
Figure 10:
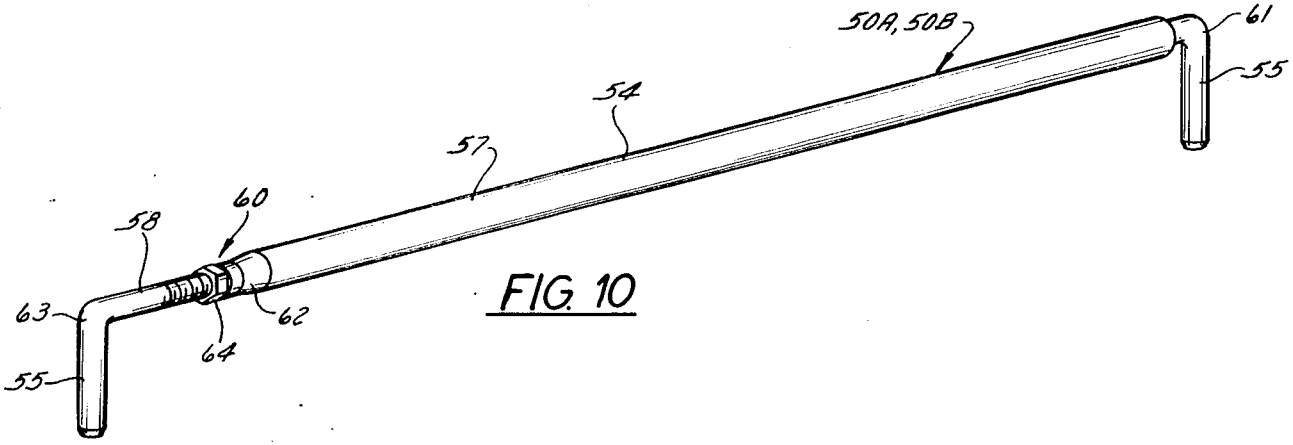
FIG. 10 is a perspective view of one of the shorter gages.

A drum mixer of the type to which this invention relates has a rigid fore-and-aft elongated frame 5 that is here shown as a trailer chassis having wheels 6 at its front so that the mixer can be towed from place to place. When in operation, however, the frame 5 is supported on jack pads 7, one at its front end and one just in front of its wheels, each extending across substantially the full width of the frame to provide a stable ground engaging support for the mixer.

Rotatably mounted on the frame 5 is a long substantially cylindrical mixing drum 8, the axis of which lies substantially over the longitudinal centerline of the frame. When the machine is used for mixing asphalt concrete, a burner 9 that is mounted on the frame 5 projects substantially coaxially into the rear end 10 of the drum. As the drum rotates about its axis, material to be mixed, charged into its rear end 10, is agitated and moved forwardly in the drum by flights (not shown) that are fixed in its interior, eventually being discharged from the drum at its front end 11. Forward movement of material in the drum is assisted by gravity, inasmuch as the drum axis is inclined to the horizontal, as pointed out above.

Surrounding the drum are concentric front and rear trunnion engaging rings 12 and 12', respectively, sometimes referred to as tires. For rotatably supporting the drum on the frame and imparting rotation to it, two pairs of trunnion units 14 are mounted on the frame, one pair for each of the trunnion engaging rings 12 and 12'. The two trunnion units of each pair are spaced to opposite sides of the drum axis, to be laterally inwardly adjacent to opposite sides of the frame.

The four trunnion units 14 are substantially identical. Each comprises a base member 15 that is mounted on the frame for lateral sliding adjustment and an axially short trunnion roller 16 that is confined to rotation relative to the base member. As pointed out hereinabove, each of the trunnion engaging rings 12, 12' has an axially short and plainly cylindrical peripheral surface 17 that is concentric to the drum axis and has flat front and rear surfaces 18 and 19, respectively. Each of the trunnion rollers 16 has a plainly cylindrical surface 20 which rollingly engages the peripheral surface 17 of its tire 12 or 12' and has a roller axis that extends substantially in the fore-and-aft direction but is skewed in relation to the drum axis as explained above.

To stabilize the drum 8 axially—or, more accurately, to limit its capability for fore-and-aft excursions—a pair of thrust rollers 22 and 23 are mounted on the frame 5 for cooperation with the front tire 12. Each of the thrust rollers is freely rotatable on a vertical axis that intersects the longitudinal centerline of the frame. The distance between the peripheries of the thrust rollers 22 and 23 is a little greater than the axial thickness of the front tire 12; hence, when the drum is in its most forward position the front thrust roller 22 is rollingly engaged with the front surface 18 of the front tire but that tire is slightly spaced from the rear thrust roller 23, whereas when the drum is in its rearmost position the front tire is engaged against the rear thrust roller 23 and is spaced slightly from the front thrust roller 22.

One end portion of each trunnion unit 14 comprises a conventional gear box 25 through which the trunnion roller 16 of the unit is rotatably driven so that it can in turn impart rotation to the drum 8. On the exterior of each gear box 25 is a drive sheave 26 which rotates on an axis that is parallel to and spaced below the axis of the trunnion roller 16 of the unit. On the frame 5 of the mixer, between each pair of trunnion units, there is mounted a motor 27 for the trunnion units of the pair, and each of said motors 27 has a driving belt connection 28 with the sheaves 26 of its laterally adjacent trunnion units. It will be understood that a gear train (not shown) inside each gear box 25 provides a driving transmission between its sheave 26 and a roller shaft 30 to which the trunnion roller 16 of the unit is coaxially anchored.

To provide for tensioning of the driving belts 28, each gear box 25 is swingable laterally relative to the base member 15 of its trunnion unit, about the axis of its trunnion roller 16. For adjusting the position of swinging motion of each gear box, there is an adjustable link 31, here shown as comprising a turnbuckle, connected between the bottom of the gear box and a fixed anchorage on the frame 5.

The base member 15 of each trunnion unit is a rigid structure that comprises a horizontal base plate 33 and a pair of pillow blocks 34 that project up from the base plate in fore-and-aft spaced relation to one another. The pillow blocks 34, which comprise suitable bearings, cooperate to rotatably support the shaft 30 for the trunnion roller 16 of the unit, the trunnion roller being located between the pillow blocks.

In the rectangular base plate 33, near its respective corners, are four bolt receiving slots 35, each elongated in the direction transverse to the axis of the trunnion roller 16. Through each of these slots 35 there extends a hold-down bolt 36 that is secured to the frame 5. When tightened these bolts 36 confine the base plate in flatwise engagement with a top surface on the frame; when loose they allow the trunnion unit to be slidingly shifted relative to the frame, both laterally to the extent permitted by the length of the slots 35 and in skewing directions to the extent that the width of the slots permits.

The weight of the drum 8 and its contents, acting through the trunnion rollers 16, tends to cam each trunnion unit 14 laterally outward with a strong force that must be overcome for adjustingly shifting the trunnion unit in the opposite direction. Therefore each trunnion unit has a pair of positioning devices 38, one for each of its pillow blocks 34, each providing an adjustable threaded connection between the base member 15 of the trunnion unit and the frame 5. Each positioning device 38 comprises an upright bracket or standard 40 that is securely anchored at its bottom to the base plate 33, laterally outwardly adjacent to a pillow block 34. At the side of this bracket 40 that is remote from the pillow block it has a hinge connection 41 with horizontally extending threaded rod 42 that projects generally away from the pillow block. The hinge connection 41 allows the rod 42 to swing about a vertical axis, to accommodate skewing adjustments of the trunnion unit. For each threaded rod 42 there is anchored to the frame 5 a sturdy upwardly projecting thrust block 43 in which there is a hole through which the threaded rod 42 extends with a sliding fit. Nuts 44 on the threaded rod 42, one at each side of the thrust block 43, hold the rod in any lengthwise position of its adjustment relative to the thrust block. It will be apparent that the nuts 44 cooperate with the rod 42 and the thrust block 43 to provide for precise shifting of the trunnion unit towards and from its adjacent side of the frame. Because there are two positioning devices 38 for each trunnion unit, spaced from one another in the fore-and-aft direction, these devices serve for adjustment of the skewing orientation of the trunnion unit as well as of its position laterally relative to the frame.

To facilitate precise adjustment of the trunnion units as to both position and orientation, the apparatus of the present invention comprises two relatively short gages 50A, 50B and a substantially longer gage 50C, and a pair of locating fixtures 52, one for each pair of trunnion units 14, that are fixed on the frame 5 as described hereinafter.

In general, each of the gages 50A, 50B and 50C is substantially U-shaped, having an elongated body portion 54 with relatively short tangs 55 projecting laterally from its opposite ends. For adjusting the length of the body portion 54, to adjustably vary the center-to-center distance between the tangs 55, the body portion comprises a pair of elongated body elements 57, 58 that are connected end-to-end, preferably by means of a threaded connection 60. Each of the gages is normally adjusted through one full turn at a time so that the two tangs 55 of the gage always project laterally in the same direction from its body portion 54.

In the presently preferred embodiment, the body element 57 of each of the shorter gages 50A, 50B comprises a straight length of pipe, and the tang 55 on that body element comprises one leg of a length of rod 61 that is bent to an L and has its other leg coaxially received in one end portion of that pipe and welded thereto. The other end portion of that pipe is provided with an internal thread, suitably by welding a nut 62 coaxially thereto and grinding down the periphery of the nut to blend into the outer surface of the pipe. The other body element 58 comprises a longer leg of another length of rod 63 that is bent to an L-shape and the shorter leg of which comprises the other tang 55. The longer leg of the rod 63 is threaded to mate with the nut 62. A jam nut 64 on the externally threaded body member 58 serves for releasably locking the body elements against relative rotation that would change the adjusted length of the gage.

On the long gage 50C, each of the body elements 57', 58' preferably comprises a length of pipe having an internal thread at its end adjacent to the other. These two lengths of pipe can be identical, and the internal thread for each can be provided by a nut 62' that is welded to the pipe as described above. The connection between these body elements 57', 58' comprises a straight length of rod 65 that is threaded along its length and on which there are a pair of jam nuts 64. Each of the tangs 55 of this long gage 50C is defined by one leg of an L-shaped length of rod 61, the other leg of which is concentrically welded into a body element pipe. On each tang 55 of the longer gage 50C, intermediate the ends of the tang, there is an auxiliary tang 66 that projects from the main tang 55 at right angles to it and transversely to the length of the body portion 54. The two auxiliary tangs 66 both project in the same direction from the main tangs 55, to serve a purpose that is explained hereinafter.

The shorter gages 50A, 50B cooperate with the two locating fixtures 52, each of which is laterally aligned with its pair of trunnion units. Both locating fixtures are at the same side of the mixer frame, hereinafter referred to as its gaging side. Each locating fixture 52 comprises a pair of upwardly projecting blocks 152, 152' which are secured to the frame 5 in fore-and-aft spaced apart relationship. Through each of these blocks there is a hole 67 of a diameter to receive the tangs 55 of the shorter gages 50A, 50B with a close sliding fit, and the axes of these several holes 67 coincide with a single line that extends substantially parallel to the longitudinal centerline of the frame 5. The front block 152 of each locating fixture 52 is so positioned on the frame 5 that it has a front surface 70 which is substantially in line with the front ends of the trunnion units 14 of its pair, while the rear block 152' of each locating fixture has a rear surface 71 which is similarly in substantial alignment with the rear ends of its trunnion units.

For cooperation with the gages 50A, 50B, 50C, every trunnion unit 14 has two holes or wells 73, 74 which respectively open to its front and rear ends and both of which are coaxial with its trunnion roller 16. Ordinarily the ends of the trunnion roller shaft 30 are overlain by concentric circular end caps 76, one on the gear box 25 and one on the pillow block 34 that is opposite the gear box, and the wells 73, 74 can be provided in the head portions of bolts 77 that are secured in central holes in these end caps. Preferably the several tangs 55 on the gages 50A, 50B, 50C are all of the same diameter, and the holes or wells 73, 74 in the trunnion units, like the holes 67 in the locating fixtures 52, are of a diameter to closely slidably receive each of the tangs 55.

In the following description of the procedure for adjusting the trunnion units 14 with the apparatus of this invention, it is assumed that all four trunnion rollers 16 are initially in positions at which they are drivingly engaging their respective tires 12, 12'. The adjustment should be made with the drum 8 loaded and operating steadily at its rate for normal production and under normal conditions. As far as possible, the trunnion units should be adjusted by shifting them laterally inwardly, since shifting them outward lowers the drum and may allow it to rub on adjacent stationary structure.

The first steps of the procedure bring the two trunnion units at the gaging side of the frame to orientations at which their trunnion roller axes are parallel. The gage 50A (one of the two shorter gages) is so adjusted as to its length that its tangs 55 can be simultaneously inserted into the front well 73 in the front gaging-side trunnion unit 14 and into the hole 67 that opens to the front surface 70 of the front locating fixture 52. Leaving the gage 50A so adjusted, the rear gaging-side trunnion unit is so adjusted by means of its front positioning device 38 that the tangs 55 of said gage 50A can be simultaneously received in its front well 73 and in the hole 67 that opens to the front surface 70 of the rear locating fixture.

Now the other shorter gage 50B is so adjusted that its tangs 55 can be received in the rear well 74 in the front gaging-side trunnion unit 14 and in the hole 67 that opens to the rear surface 71 of the front locating fixture 52. Assuming that the drum 8 rotates clockwise as viewed from its rear (charging) end, the gage 50B will then be longer than the gage 50A, owing to the skew of the axis of the front gaging-side trunnion roller 16. Leaving the gage 50B so adjusted, the rear gaging-side trunnion unit 14 is so adjusted by means of its rear positioning device 38 that the tangs 55 of the gage 50B can be simultaneously received in its rear well 74 and in the hole 67 that opens to the rear surface 71 of the rear locating fixture 52. Such adjustment may disturb the position of the front end of the rear gaging-side trunnion unit, which should now be rechecked with the gage 50A and readjusted if necessary.

The next stage of adjustment brings the roller axes of the trunnion units 14 near the other side of the frame into parallelism with those of the trunnion units near the gaging side. For this the long gage 50C is used. It is adjusted to a length such that its tangs 55 can simultaneously enter the front wells 73 in the two trunnion units of the front pair. If the belly of the drum 8 extends below a straight line that connects the axes of the wells 73 of the front pair of trunnion units, then the auxiliary tangs 65 can be inserted into those wells. As so adjusted, the long gage 50C is used with the rear wells 74 of the front trunnion units to make the necessary adjustment on the front trunnion unit at said other side of the frame and thus bring the roller axis of that front trunnion unit into parallelism with that of the other front trunnion unit. In an obvious manner, and still without changing the adjustment of the long gage 50C, it is used to orient the rear trunnion unit at said other side of the frame to bring its roller axis into parallelism with that of the rear gaging-side trunnion unit.

With the roller axes of the several trunnion units thus brought into accurate parallelism, the operation of the drum is observed. If it tends to move forward as it rotates, or bears heavily against the front thrust roller 22, the shorter gage 50B is lengthened by relative rotation of its body elements through one turn. The rear portion of the front gaging-side trunnion unit is then adjustingly shifted as necessary to accommodate this newly adjusted length of the gage 50B, and the rear gaging-side trunnion unit is then similarly adjusted. These adjustments effect equal incremental laterally inward shifts of the rear ends of the gaging-side trunnion units, slightly increasing the skew of their roller axes. With the long gage 50C shortened by one turn, the trunnion units at the other side are now adjusted as before, to bring them into parallelism with those at the gaging-side. This readjustment procedure is repeated as necessary to bring the skew of the trunnion units to the correct value.

If the drum tends to move rearward after a complete initial adjustment, or bears hard against the rear thrust roller 23, a readjustment is made, and is repeated as necessary, to decrease the skew of the trunnion units to a proper value. For each such skew-decreasing readjustment the gage 50A is lengthened by one turn and the long gage 50C is shortened by one turn.

It will be apparent that the threaded connections between the body elements 57, 58 of the several gages 50A, 50B, 50C should be of like pitch, so that one-turn adjustments of the gages lengthen or shorten them by like amounts. The gages thus provide for readjustments to be made in small, uniform increments, equal to the pitch of said threaded connections, which is preferably on the order of 1/16 in. per turn.

As a result of the above described adjustment procedures the drum may be brought to a position or an orientation in which its axis is slightly to one side of the longitudinal centerline of the frame and/or is slightly oblique to that centerline. Since such asymmetry will seldom amount to more than a fraction of an inch, it will be of no consequence.

It will be observed that the use of the gages makes for a systematic adjustment of the trunnion units and clearly shows the direction and amount of shift that each must be given. Thus the gages 50A and 50B are always applied to the locating fixtures and the gaging-side trunnion units, the gage 50A to the front holes in them and the gage 50B to their rear holes, while the longer gage 50C is always applied to the two trunnion units of a pair, front to front and rear to rear.

From the foregoing description taken with the accompanying drawings it will be apparent that this invention provides means for quickly and accurately positioning the trunnion units of a drum mixer of the character described to assure a long useful life for the drum tires and the trunnion rollers of the mixer and also for its thrust rollers.

What is claimed as the invention is:

1. In combination with a drum mixer comprising a rigid frame that is elongated in a fore-and-aft direction, an axially elongated drum that has a drum axis and is encircled by coaxial front and rear trunnion engaging rings, and two pairs of trunnion units, one pair for each said ring, whereby the drum is driven for rotation and is supported above a top surface of the frame and between opposite sides thereof with its axis extending substantially in said direction, the two trunnion units of each pair being at opposite sides of the drum axis, and each said trunnion unit having front and rear ends which are spaced apart substantially in said direction and comprising a base member which is slidingly shiftable on said top surface transversely to said fore-and-aft direction and which carries a roller that supportingly and drivingly engages its ring, said roller being confined to rotation relative to the base member about a roller axis that extends through said front and rear ends, means for facilitating accurate adjustment of the positions of the trunnion units comprising:

A. means on each trunnion unit defining a pair of holes that are coaxial with said roller axis of the trunnion unit, one of said holes opening to the front end of the trunnion unit and the other to its rear end;

B. a pair of locating fixtures fixed on the frame, both adjacent to one side thereof, there being one of said locating fixtures for each pair of trunnion units, and each said locating fixture having (1) front and rear end surfaces that are substantially aligned with the front and rear ends, respectively, of the trunnion units of its pair, and (2) a hole opening to each of said end surfaces, the axes of said holes in both locating fixtures coinciding with a single line extending in said fore-and-aft direction; and C. at least one substantially U-shaped gage having
(1) an elongated body portion
(2) a tang projecting laterally from the body portion at each end thereof, each said tang being closely slidably receivable in each of said holes, and
(3) means on said body portion for adjustably varying the distance between said tangs.

2. The combination of claim 1 wherein there are three of said U-shaped gages, characterized in that:
(1) two of said gages are relatively short, for positioning the one trunnion unit of each pair thereof that is adjacent to said one side of the frame in relation to said single line, and
(2) the third of said gages is relatively long, for positioning the other trunnion unit of each pair in relation to said one trunnion unit of its pair.

3. The combination of claim 2, further characterized by: said elongated body portion of each said gage comprising:
(1) a pair of elongated body elements each of which has one of said tangs secured to one end thereof, and
(2) means providing a threaded connection between said body elements, at the other end of each, providing for adjustment of said distance between the tangs by rotation of said body elements relative to one another.

4. The combination of claim 3 wherein said threaded connection of each gage has the same pitch as that of the others.

5. The combination of claim 2 wherein said third gage is further characterized by:
an auxiliary tang projecting laterally from each tang intermediate the ends thereof, each said auxiliary tang being closely slidably receivable in said holes in the trunnion units and having its length transverse to that of the tang from which it projects and to that of the body portion of said third gage.

6. The combination of claim 1 wherein each of said locating fixtures comprises a pair of upright blocks that are spaced apart in said fore-and-aft direction, one of which defines said front surface and the other of which defines said rear surface and in each of which there is one of said holes.

7. In combination with a drum mixer comprising a rigid frame that is elongated in a fore-and-aft direction, an axially elongated drum that has a drum axis and is encircled by coaxial front and rear trunnion engaging rings, and two pairs of trunnion units, one pair for each said ring, whereby the drum is driven for rotation and supported above a top surface of the frame and between opposite sides thereof with its axis extending substantially in said direction, the two trunnion units of each pair being at opposite sides of the drum axis, and each said trunnion unit having front and rear ends which are spaced apart in said direction and comprising a base member which is slidingly shiftable on said top surface transversely to said fore-and-aft direction and which carries a roller that supportingly and drivingly engages its ring, said roller being confined to rotation relative to the base member about a roller axis that extends through said front and rear ends, means for facilitating accurate adjustments of the trunnion units comprising:

A. means on each trunnion unit defining a pair of wells that are coaxial with said roller axis of the trunnion unit, one of said wells opening to the front end of the trunnion unit and the other to its rear end;

B. a pair of locating fixtures fixed on the frame, both adjacent to one side thereof, there being one of said locating fixtures for each pair of trunnion units, and each said locating fixture having
(1) front and rear end surfaces that are substantially aligned with the front and rear ends, respectively, of the trunnion units of its pair, and
(2) a hole opening to each of said end surfaces, the axes of said holes in both locating fixtures coinciding with a single line extending in said fore-and-aft direction;

C. a pair of substantially U-shaped gages,
(1) each having
(a) an elongated body portion,
(b) tang projecting laterally from said body portion at each end thereof, and
(c) means on said body portion for adjustably varying the distance between said tangs,
(2) one of said U-shaped gages being relatively short and having
(a) one of its tangs closely slidably receivable in said holes and
(b) its other tang closely slidably receivable in said wells, to be used for positioning, in relation to said single line, the one trunnion unit of each pair that is adjacent to said one side of the frame, and
(3) the other of said U-shaped gages being substantially longer and having each of its tangs receivable in said wells, to be used for positioning the other trunnion unit of each pair in relation to said one trunnion unit thereof.

8. The combination of claim 7, wherein said one U-shaped gage has its said one tang receivable in said holes that open to said front surfaces of the locating fixtures and has its other tang closely receivable in said wells that open to the front ends of the trunnion units, further characterized by:
a second relatively short gage substantially similar to said one gage and having
(1) one of its tangs closely slidably receivable in said holes that open to the rear surfaces of the locating fixtures and
(2) its other tang closely slidably receivable in said wells that open to the rear ends of the trunnion units,
to be cooperable with said one relatively short gage for locating said one trunnion unit of each pair in relation to said single line.

* * * * *